US007296686B2

(12) United States Patent
Grey

(10) Patent No.: US 7,296,686 B2
(45) Date of Patent: Nov. 20, 2007

(54) DIRECTIONAL NOZZLE FOR A SPIRAL SEPARATOR

(75) Inventor: Thomas J. Grey, Jacksonville, FL (US)

(73) Assignee: Outotec Oyj, Espoo (FI)

( * ) Notice: Subject to any disclaimer, the term of this patent is extended or adjusted under 35 U.S.C. 154(b) by 226 days.

(21) Appl. No.: 10/651,881

(22) Filed: Aug. 29, 2003

(65) Prior Publication Data

US 2005/0077393 A1 Apr. 14, 2005

(51) Int. Cl.
*B03B 5/52* (2006.01)

(52) U.S. Cl. ..... 209/434; 209/459; 209/500

(58) Field of Classification Search ..... 209/362, 209/434, 459, 488, 493, 497, 500, 697; 134/132; 222/171, 172
See application file for complete search history.

(56) References Cited

U.S. PATENT DOCUMENTS 641,359 A * 1/1900 Barrow ..... 209/16
1,123,254 A * 1/1915 Darrow ..... 209/500
2,431,559 A * 11/1947 Humphreys ..... 209/459
2,615,572 A * 10/1952 Hodge ..... 209/454
2,952,360 A * 9/1960 Oberg ..... 209/18
3,753,491 A * 8/1973 Vollmer ..... 209/459
4,183,806 A * 1/1980 Giffard ..... 209/459
4,428,830 A * 1/1984 Hepfner et al. ..... 209/724
4,505,811 A * 3/1985 Griffiths et al. ..... 209/13
6,527,125 B2 3/2003 Niitti

FOREIGN PATENT DOCUMENTS

GB 1 371 241 * 10/1974

* cited by examiner

*Primary Examiner*—Joseph C. Rodriguez
(74) *Attorney, Agent, or Firm*—Arthur G. Yeager

(57) ABSTRACT

A washing liquid distribution system includes a spiral separator having a plurality of flights, each flight including at least one receiving cup for distributing liquid onto the flight. A directional outlet nozzle is mounted in cup for providing a horizontal outlet stream of a liquid. The nozzle is both rotatably and releasably mounted in a recess at the bottom of the cup. One or more outlet openings in a variety of geometric shapes to provide the desired outlet stream of wash liquid.

21 Claims, 4 Drawing Sheets

DIRECTIONAL NOZZLE FOR A SPIRAL SEPARATOR

CROSS REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to nozzles used in washing liquid distribution systems particularly to nozzles used in spiral separators.

2. Relevant Art

The present invention relates to nozzles used in spiral separators such as those illustrated in U.S. Pat. No. 6,527,125 to Niitti.

BRIEF SUMMARY OF THE INVENTION

In one aspect of the present invention there is provided in a washing liquid distribution system comprising a spiral separator including a plurality of flights, each flight including at least one receiving cup for distributing liquid onto the flight, a directional outlet nozzle mounted in the cup for providing a horizontal outlet stream of a liquid. The nozzle is rotatably mounted in the cup. The nozzle is releasably mounted to the cup. The nozzle has either a single outlet opening or two oppositely disposed outlet openings. The nozzle has an elongated lower portion extending downwardly from the cup and an upper portion for mounting the nozzle to the cup. The outlet opening is located in the lower portion. The lower portion has a vertically disposed portion and a horizontal substantially planar portion, the outlet opening being in the vertically disposed portion. The nozzle includes a housing having an exterior surface formed to include a pair of oppositely disposed flat portions for grasping the nozzle by a user.

In another aspect of the present invention there is provide in a washing liquid distribution system comprising a spiral separator including a plurality of flights, each flight including at least one receiving cup for distributing liquid onto the flight, a directional outlet nozzle rotatably mounted in the cup, the cup having one horizontally disposed outlet opening for providing a horizontal outlet stream of a liquid. The nozzle is releasably mounted to the cup. The nozzle has a second outlet opening oppositely disposed from the one outlet opening. The nozzle has an elongated lower portion subtending from the cup and an upper portion for mounting the nozzle to the cup. The one outlet opening is located in the lower portion. The lower portion has vertically a disposed portion and a horizontal substantially planar portion, the one outlet opening being located in the vertically disposed portion. The nozzle includes a housing, the housing including an exterior surface having a pair of oppositely disposed flat portions for grasping the nozzle by a user.

In a further aspect of the present invention there is provided in a washing liquid distribution system comprising a spiral separator including a plurality of flights, each flight including at least one receiving cup for distributing liquid onto the flight, a direction outlet nozzle rotatably and releasably mounted in the cup the cup having one horizontal disposed outlet opening for providing a horizontal outlet stream of a liquid. The one outlet opening is a substantially circular passageway or it is a substantially vertically disposed rectangular slot. The one outlet opening is formed by a pair of vertically disposed elongated curved sides, each side having an upper portion and a lower portion, the upper portions of the sides being joined together and the lower portion of the sides joined together to form the one outlet opening.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof may best be understood by reference to the following description taken in connection with the accompanying drawings in which:

DETAILED DESCRIPTION OF THE INVENTION

Figure 1:
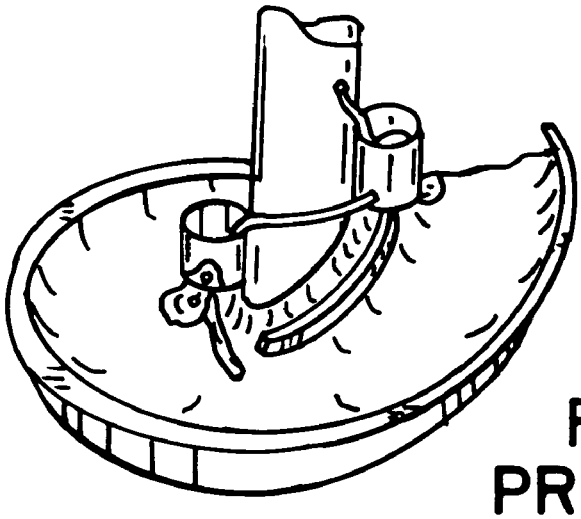
FIG. 1 PRIOR ART
FIG. 1 is a perspective view of a portion of a spiral separator according to the prior art.

U.S. Pat. No. 6,527,125 discloses a washing liquid distribution system employing spiral separators. Internally a plurality of dampening receivers receive the washing liquid into a top portion and provide a low kinetic energy liquid flow output onto the material being separated via the distribution system (FIG. 1).

Control of the flow in many separation systems is accomplished via pet-cocks or valves in line with a supply hose. Because the outlet flow is to be very low, very small openings are provided. The disadvantage with this approach is that the openings are subject to clogging. A larger opening can be used to prevent clogging but the very low flow required to aid in separation results in an unstable liquid stream.

In the present invention, the outlet from a receiver is via a small passageway formed in a removable and rotatable insert mounted in the bottom of the receiver. The inserts provide outlet holes that can be elongated in the vertical or horizontal or both directions.

The inserts provide a means whereby the outlet stream can be directed towards the vertical divider that separates the separator trough from the concentrate trough with the stream having a horizontal component. The horizontal component of the flow can be directed upstream or downstream as desired in the circumstances. The small head developed within the insert provides for a stable flow stream. In addition, a larger outlet opening prevents clogging.

Figure 2:
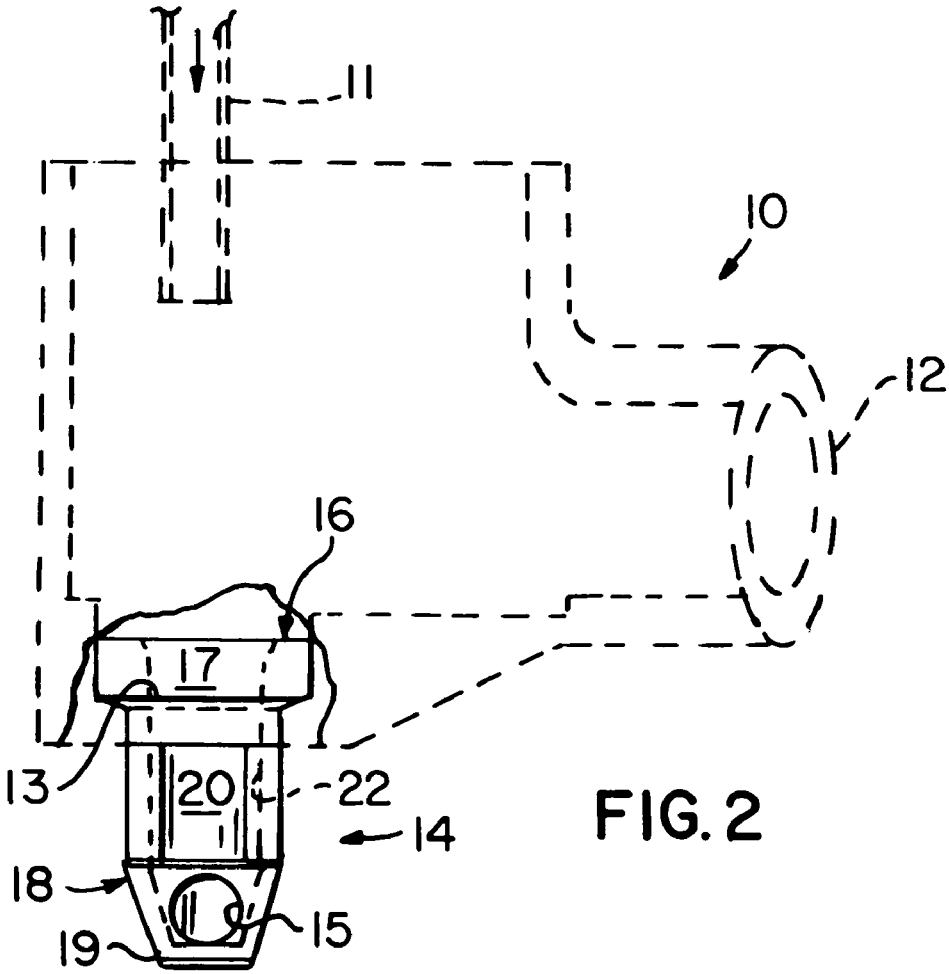
FIG. 2 is a front view of the directional nozzle in accordance with the present invention.

With respect to the drawings, FIG. 2 illustrates receiver cup 10 having an inlet flow pipe 11. The specific construction of cup 10 may vary In the circumstances. In particular, horizontal pipe 12 (shown in broken line) may be provided to direct some of the incoming flow to another cup 10 as illustrated in Pat. No. 6,524,125, referenced hereinabove and incorporated herein in its entirety.

The receiver cup 10 preferably is formed to provide a recess 13 into which the directional nozzle formed as an insert 14 will be mounted. Recess 13 provides a collection point for the incoming liquid to stabilize the liquid flow prior to exiting via horizontally disposed outlet opening 15. The diameter, shape, and angle with the horizontal of the outlet 15 vary with the specific separation application.

The upper portion 16 of insert 14 is formed as a flange 17 that fits tightly into recess 13. The lower portion 18 is sized in height to create a head of approximately 1.0" to provide for a stable stream. The lower tapered portion 19 assists in directing the flow to outlet 15. Preferably, insert 14 has a pair of oppositely disposed flats 20 to allow the insert 14 to be rotated to position outlet 15 in the desired location.

Figure 2A:
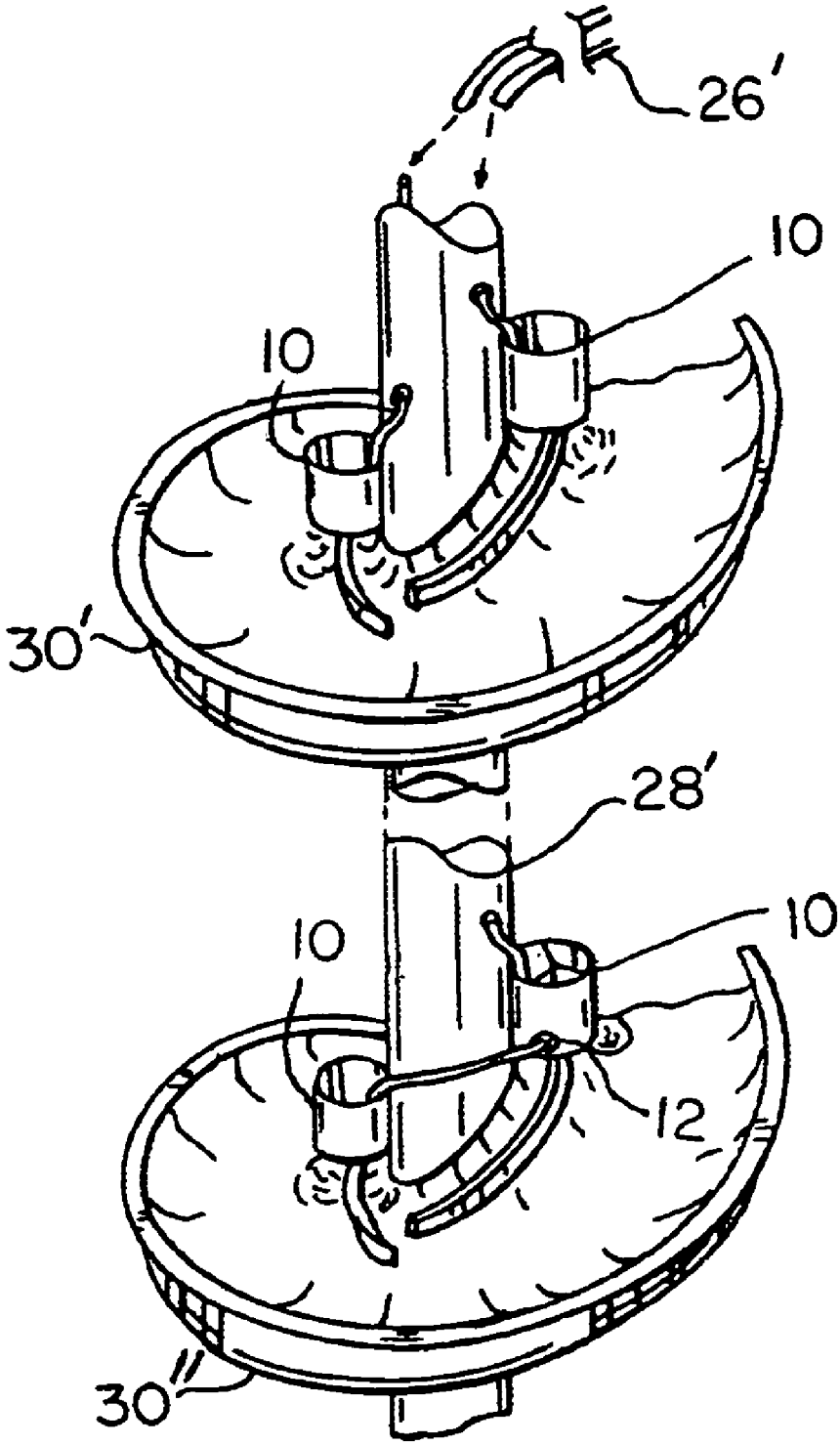
FIG. 2A is a perspective view of a portion of a spiral separator utilizing a directional nozzle in accord with the present invention.

FIG. 2A illustrates the relationship of receiving cups 10 in accord with the present invention with respect to the spiral separator. With regard to the upper flight 30', an upper receiving cup 10 feeds water onto the flight 30' as does a lower cup 10. An outlet pipe 12 is not used in this particular configuration. See U.S. Pat. No. 6,524,125.

The lower flight 30"(preferably identical to upper flight 30') in FIG. 2A employs an upper receiving cup 10 that includes outlet pipe 12 to feed into a lower cup 10 which provides effluent only to the flight 30".

Each receiving cup 10 is identical but may employ different nozzles such as those shown in FIGS. 2-8 as desired in a specific application. Incoming flow is directed by the hoses 26' and pipe 28' that may be of any appropriate size or number for the specific application.

Figure 3:
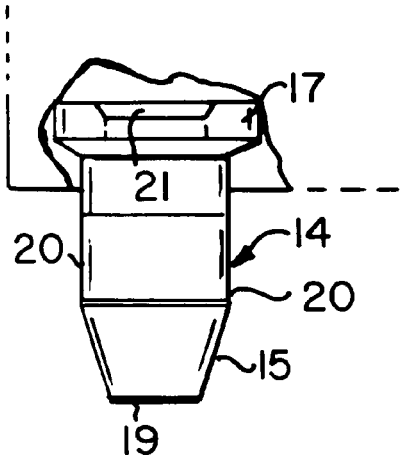
FIG. 3 is a side view of the nozzle of FIG. 2.

A side view of insert 14 is illustrated in FIG. 3. Flange 17 is formed to provide a smooth rounded inlet portion 21 to further stabilize the incoming flow downwardly through passageway 22 for greater stability of the outlet stream. The insert 14 is formed of material that is appropriate in the circumstances.

Figure 4:
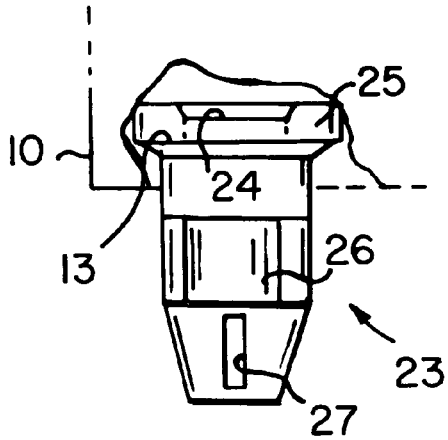
FIG. 4 is a front view of an alternative embodiment of a directional nozzle in accord with the present invention.

With respect to FIG. 4, an alternate insert 23 having a rounded inlet 24 and flange 25 that fits tightly into a recess 13 of a cup 10. Flats 26 provide a means for grasping the insert 23 and rotating it to a desired position. The outlet 27 is a vertically elonoated generally rectangular slot that provides a horizontally directed flow.

Figure 5:
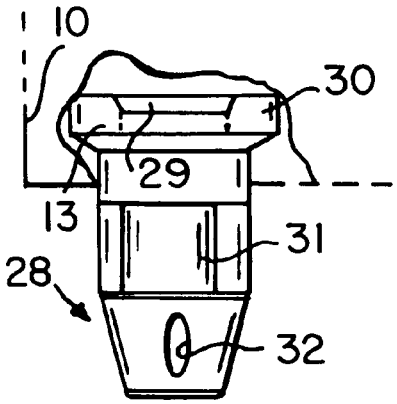
FIG. 5 is a front view of another embodiment of a directional nozzle in accord with the present invention.

In FIG. 5, another embodiment of a directional nozzle in accord with the present invention is illustrated by insert 28. A rounded inlet 29 and flange 30 fits tightly into recess 13 of a cup 10. Flats 31 allow for rotation of the insert 28. Outlet 32 is formed as a curved slot to provide a horizontally directed outlet stream.

Figure 6:
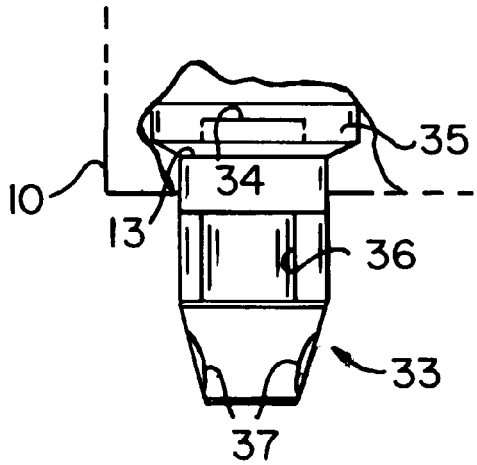
FIG. 6 is a side view of another directional nozzle in accordance with the present invention.

In FIG. 6, another embodiment of a nozzle is illustrated by insert 33 having a rounded inlet 34 and flange 35 fits into recess 13. Flats 36 provide a grasping surface as before. Two oppositely disposed outlets 37 are provided to allow for two oppositely disposed horizontal outlet streams.

Figure 7:
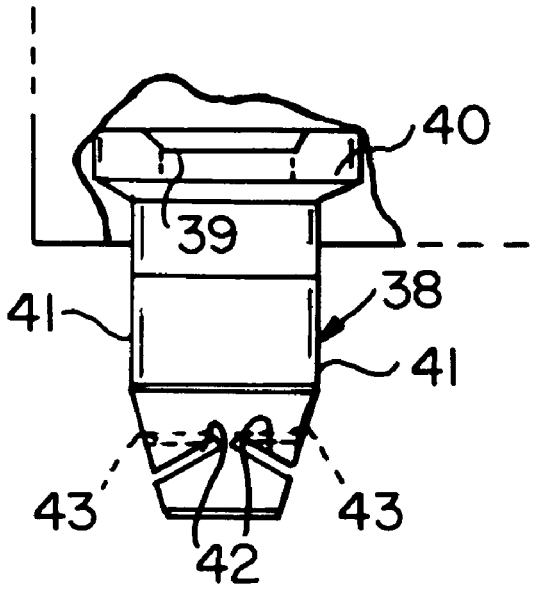
FIG. 7. is a side view of another directional nozzle in accordance with the present invention.
Figure 8:
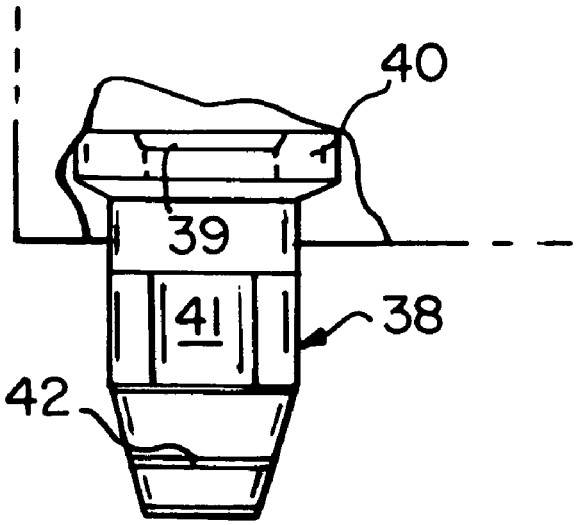
FIG. 8 is a front view of the nozzle of FIG. 7.

In FIGS. 7 and 8, an embodiment of an insert 38 having outlets formed as angled slits 42 formed therein. Inlet 39, flange 40, and flats 41 are as before. The slits 42 provide a substantially horizontal fan-like outlet stream. Alternatively the slits 42 may be horizontal as shown by broken lines 43 or any angle between the approximately 45° angle of slits 42 and slits 43.

The particular insert chosen for a given application will depend on the material that is being processed as understood in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desirous to secure by Letters Patent of the United States is:

1. In a washing liquid distribution system having a spiral separator including a plurality of flights, some of said flights respectively including at least one receiving cup for distributing liquid onto said flights, the improvement comprising a directional outlet nozzle having at least one horizontally disposed outlet opening located below a bottom of at least one receiving cup, said at least one receiving cup supporting said nozzle, said nozzle being movably adjustable for providing at least one horizontal outlet stream of a liquid in different horizontal directions.

2. In the system as defined in claim 1 wherein said nozzle is rotatably mounted in said at least one receiving cup.

3. In the system as defined in claim 1 wherein said nozzle is releasably mounted to said at least one receiving cup.

4. In the system as defined in claim 1 wherein said nozzle is releasably and rotatably mounted to said at least one receiving cup.

5. In the system as defined in claim 1 wherein said nozzle has a single outlet opening.

6. In the system as defined in claim 1 wherein said nozzle has two oppositely disposed outlet openings.

7. In the system as defined in claim 1 wherein said nozzle has an elongate lower portion extending downwardly from said at least one receiving cup and an upper portion for mounting said nozzle to said at least one receiving cup.

8. In the system as defined in claim 1 wherein said at least one outlet opening is located in said lower portion.

9. In the system as defined in claim 7 wherein said lower portion has a vertically disposed portion and a horizontal substantially planar portion, said at least one outlet opening being disposed in said vertically disposed portion.

10. In the system as defined in claim 1 wherein said nozzle includes a housing, said housing including an exterior surface having a pair of oppositely disposed flat portions for grasping said nozzle by a user.

11. In a washing liquid distribution system having a spiral separator including a plurality of flights, some of said flights respectively including at least one receiving cup for distributing liquid thereon, the improvement comprising a directional outlet nozzle adjustably and rotatably mounted in said receiving cup, said nozzle having at least one horizontally disposed outlet opening located below a bottom of said receiving cup for providing at least one horizontal outlet stream of a liquid in different horizontal directions.

12. In the system as defined in claim 11 wherein said nozzle is releasably mounted to said at least one receiving cup.

13. In the system as defined in claim 11 wherein said nozzle has a second outlet opening oppositely disposed from said one outlet opening.

14. In the system as defined in claim 11 wherein said nozzle has an elongate lower portion subtending from respective said at least one receiving cup and an upper portion for mounting said nozzle to said at least one receiving cup.

15. In the system as defined in claim 11 wherein said at least one outlet opening is located in said lower portion.

16. In the system as defined in claim 14 wherein said lower portion has a vertically disposed portion and a horizontal substantially planar portion, said at least one outlet opening being located in said vertically disposed portion.

17. In the system as defined in claim 11 wherein said nozzle includes a housing, said housing including an exterior surface having a pair of oppositely disposed flat portions for grasping said nozzle by a user to alter the direction of said at least one horizontal outlet stream of a liquid.

18. A washing liquid distribution system comprising a spiral separator including at least one flight, said at least one flight including at least one receiving cup for distributing liquid onto respective said flight, a directional outlet nozzle rotatably and selectively releasably mounted in said cup, said nozzle having at least one horizontal disposed outlet opening below a bottom of said at least one receiving cup for providing horizontal outlet stream of a liquid at selective horizontal positions onto said at least one flight.

19. In the system as defined in claim 18 wherein said at least one outlet opening is a substantially circular passageway.

20. In the system as defined in claim 18 wherein said one outlet opening is a substantially vertically elongated rectangular slot.

21. In the system as defined in claim 18 wherein said one outlet opening is formed by a pair of vertically disposed elongate curved sides, each said side having an upper portion and a lower portion, said upper portions of said sides being joined together and said lower portion of said sides joined together to form said one outlet opening.

* * * * *